United States Patent [19]

Perl

[11] 3,983,692

[45] Oct. 5, 1976

[54] LINK CHAIN

[76] Inventor: Alexander Perl, Niebelungenstrasse 6, 7530 Pforzheim, Germany

[22] Filed: Aug. 22, 1975

[21] Appl. No.: 606,861

[30] Foreign Application Priority Data

May 3, 1975 Germany ..... 2519791

[52] U.S. Cl. ..... 59/35 R; 59/82; 59/90; 64/2 P

[51] Int. Cl.[2] ..... F16G 13/18

[58] Field of Search ..... 59/80, 82, 35, 78, 90, 59/91; 63/4, 3; 64/2 R, 2 P; 224/4 B, 4 D, 4 H

[56] References Cited

UNITED STATES PATENTS

| | | | |
|---|---|---|---|
| 166,334 | 8/1875 | Bonta | 59/90 |
| 3,339,294 | 9/1967 | Byrnes | 59/35 |
| 3,416,306 | 12/1968 | Nakagawa | 59/80 |
| R9,578 | 2/1881 | Church | 59/91 |

*Primary Examiner*—C.W. Lanham
*Assistant Examiner*—Gene P. Crosby
*Attorney, Agent, or Firm*—Joseph A. Geiger

[57] ABSTRACT

A link chain for jewelry and other applications, the chain being composed of links having cross-sectionally enlarged longitudinal leg portions, thereby concealing the eyes of adjoining links and producing the appearance of a "full" chain. The cross-sectional profile of the leg portions may be such that the resultant chain has the overall shape of a cylinder, an octagonal prism, or a square prism, for example.

20 Claims, 7 Drawing Figures

LINK CHAIN

BACKGROUND OF THE INVENTION

1. Field of the Invention

The present invention relates to link chains, and more particularly to link chains with sculptured links for decorative and other purposes and to a method of producing such links and link chains, especially of die-cutting the links from continuous wire stock.

2. Description of the Prior Art

A wide variety of link chains, for both decorative and industrial purposes, are known. It is also known to produce link chains, especially jewelry and pendant chains, from wire stock of rectangular cross section, by piercing a rectangular eye through the stock and by transversely cutting it to obtain a generally rectangular link having a square or rectangular cross-sectional profile in its longitudinal leg portions as well as on its transverse linking portions. Such a chain resembles the regular link chain, whose oblong links are bent from round wire, and it has similar characteristics of handling. Its shortcomings are twofold: The chain has a somewhat rough exterior, giving it considerable frictional resistance against articles of clothing and against the skin; and the chain is in appearance similar to an ordinary link chain in that the separate links and their interlocking loop portions are clearly visible.

SUMMARY OF THE INVENTION

Underlying the present invention is therefore the primary objective of suggesting an improved link chain which does not have the above-mentioned disadvantages and which is nevertheless suitable for mass production at very low cost.

In order to attain this objective, the invention suggests a novel link chain whose links are sculptured so as to substantially fill the cross-sectional space within a continuous longitudinal profile, thereby giving a "full" appearance, by hiding from vision the transverse openings or eyes of the links. To achieve this, the invention features a link of generally rectangular overall outline, having two longitudinal leg portions of considerably greater width than the two linking portions on the longitudinal ends of the link. Radial gaps between the cooperating links and appropriate clearances between the linking portions of one link and the eye of the other link nevertheless give the assembled link chain considerable flexibility, so that it lends itself for use as a jewelry and pendant chain. The "fullness" and continuity of the chain profile make it particularly suited for applications where the friction against articles of clothing and/or against the skin is to be minimized.

By way of a preferred embodiment, the invention suggests a link chain whose links have a leg portion profile which widens radially outwardly from the linking portions within a sector angle substantially comprised between 70° and 80°, leaving corresponding radial gaps of an angle between 10° and 20°. The outer, exposed profile portion may be selected according to the particular application of the chain, using facets, arcs, flat faces, and even concave surfaces. Thus, the overall profile of the chain may be that of an octagonal prism, of a cylinder, of a square prism, or of some other simple, regular cross-sectional outline, while the links themselves have a generally I-shaped cross section.

The link chain of the invention is also adaptable for other than decorative use, due to its capability of transmitting both rotary and longitudinal movements, if the chain is suitably guided. For this purpose, the chain would preferably have a cylindrical cross-sectional outline, being confined inside a suitable sheath. Such a combination can be used both as a bowden-type device, for the transmission of push-pull motions, or as a flexible shaft, for the transmission of rotary motion. While the flanks defining the radial gaps between the leg portion profiles may be parallel, in the case of rotary motion transmittal, it may be preferable to have the flanks coincide with a longitudinal center plane, so as to obtain larger contact areas between the cooperating links.

The present invention further suggests a novel mothod of manufacturing the suggested link chain, by cutting the individual links from a continuous length of wire stock. The latter has a rolled or extruded profile that corresponds to the cross-sectional profile of a chain link. It is then only necessary to pierce the central eye and to split open one of the linking portions, before or after the link has been sheared off the wire stock. The finished link is then bent open, inserted over the preceding link, and bent shut. The operations of piercing the eye opening and splitting one of the linking portions may be conveniently combined in a single die-cutting operation.

BRIEF DESCRIPTION OF THE DRAWINGS

Further special features and advantages of the invention will become apparent from the description following below, when taken together with the accompanying drawings which illustrate, by way of example, several embodiments of the invention, represented in the various figures as follows.

DESCRIPTION OF PREFERRED EMBODIMENTS

Figure 1:
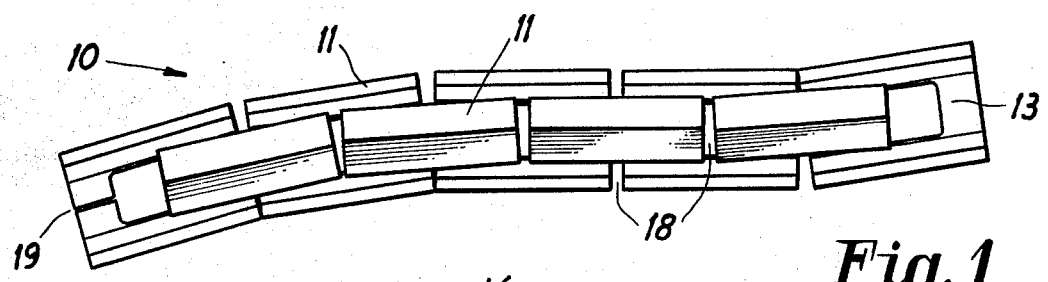
FIG. 1 shows a short piece of a link chain embodying the present invention.
Figure 3:
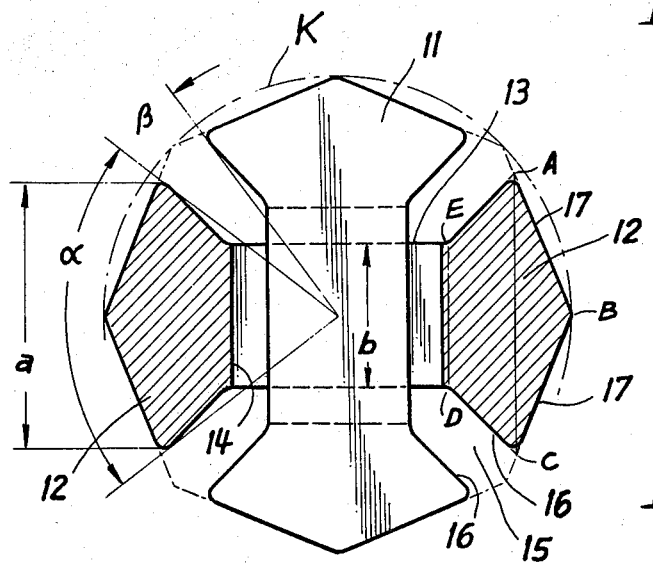
FIG. 3 is a transverse cross section through the chain of FIGS. 1 and 2, taken along line III—III of FIG. 2.
Figure 2:
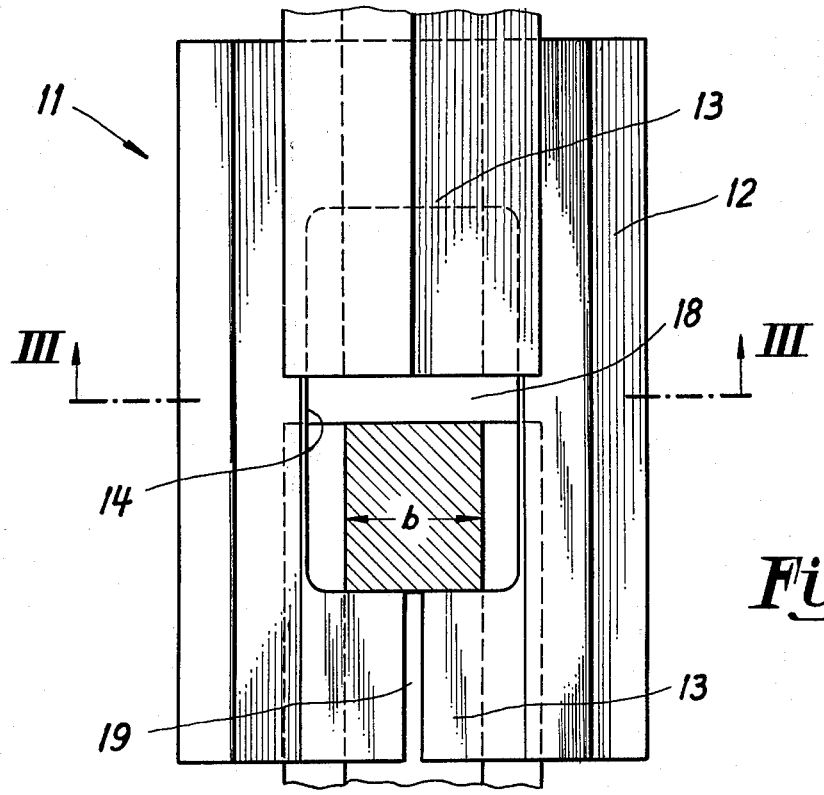
FIG. 2 shows a greatly enlarged single link of the chain of FIG. 1, portions of the adjoining links being cut away.
Figure 4:
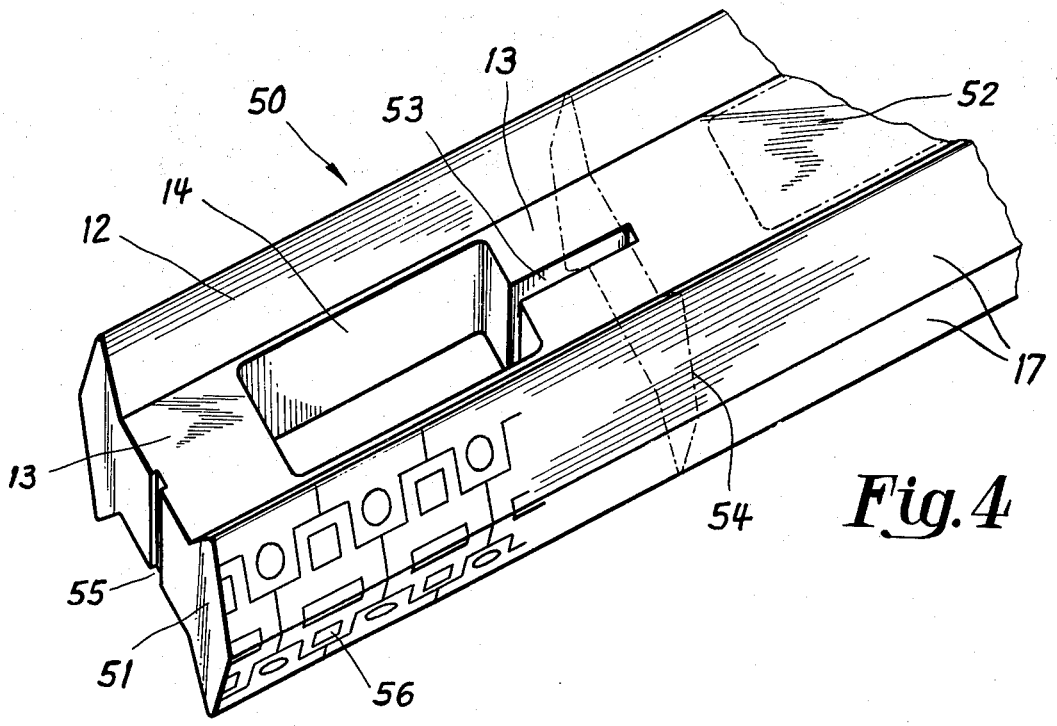
FIG. 4 shows wire stock from which links like those of FIGS. 1–3 may be manufactured.

Referring to FIG. 1 of the drawing, there is illustrated a short section of an assembled link chain 10 consisting of a succession of identical links 11 engaging each other with interlocking loops. The links 11, of which two are shown at an enlarged scale in FIGS. 2 and 3, are obtained in a die-cutting operation from rolled or extruded wire stock having an I-shaped profile (FIG. 4). The resulting link 11 has a generally rectangular overall outline, defined by two longitudinal leg portions 12 and two transverse linking portions 13. A central, likewise rectangular aperture or eye 14 defines the inner edges of the leg portions 12 and of the linking portions 13.

As FIG. 3 illustrates, the leg portions 12 of the link 11 are considerably larger in cross-sectional width than the linking portions 13, so as to substantially fill out — with the corresponding leg portions of the cooperating links — the space which is circumscribed by a circle K whose diameter is equal to the maximum diameter of the assembled chain 10. Only four identical, regularly spaced radial gaps 15, defined by the flanks 16 of the leg portions 12 remain between the links 11. The leg flanks 16 are shown to be parallel, being the result of a special polygonal leg portion profile which consists essentially of an isosceles triangle defined by the corners A, B, and C, to which is joined a trapezoid defined by the corners A, C, D, and E. The width a of the leg portion 12, somewhat less than the distance between the corner points A and C of the polygon, because of rounded corners, is thus considerably larger than the width *b* of the linking portion 13, i.e. the distance between the corner points E and D. If the vertex angle of the constituent triangle A-B-C is made 135°, then the outer faces or facets 17 of the longitudinal leg portions 12 coincide with the facets of a regular, octagonal prism inscribed within the circle K.

The result of this profile geometry is that the assembled chain (FIG. 1) has a "full", yet flexible, configuration of octagonal cross-sectional outline, which is not only pleasing in appearance, but also smooth to the touch and compatible with articles of clothing and skin or other objects that might come into frictional contact therewith, because the various facets 17 of the cooperating links form a substantially continuous prismatic outer surface.

The desirable "fullness" of the novel link chain of the invention necessarily limits the mobility of its joints somewhat, as can be seen in FIG. 1. This limited loopability of the chain may be desirable and advantageous for certain decorative uses. The degree of mobility between the chain links is determined primarily by the width of the longitudinal gaps 18 between adjacent links, as determined by the difference in length between the eye 14 and the two linking portions 13 (FIG. 2), and secondarily by the angular width of the radial gaps 15 between overlapping leg portions 12 of interlocking links 11. The angular width of the gaps 15 is preferably such that the sector angle $\alpha$ of the polygonal leg portion profile lies between 70° and 80°, leaving a corresponding gap angle $\beta$ of between 10° and 20°.

The limited angular gap $\beta$ between cooperating links 11 also means that the chain has a limited torsional freedom, so that a torque can be transmitted from link to link, after each link is rotated over the angle $\beta$, so as to engage the adjoining link at or near the corner A or C of the leg portion profile. This rotation transmitting capability of the novel chain of the invention is further enhanced in the alternative embodiment of the invention shown in FIG. 5, where the links 21 have longitudinal leg portions 22 defining a substantially cylindrical outer chain contour. This shape is obtained by replacing the outer facets of the previously described embodiment with a concentric arc 27, extending between the corners A and C of the trapezoidal profile portion A-C-D-E. The resulting cylindrical link chain, of a diameter corresponding to the circle K, has a solid and "full" appearance and a smooth substantially continuous outer surface. The latter thus makes it possible to envelop the link chain with a sleeve or sheath inside which the chain may execute longitudinal motions, in a fashion comparable to a bowden cable, or the chain may rotate inside the sheath, thereby serving as a flexible shaft.

Figure 5:
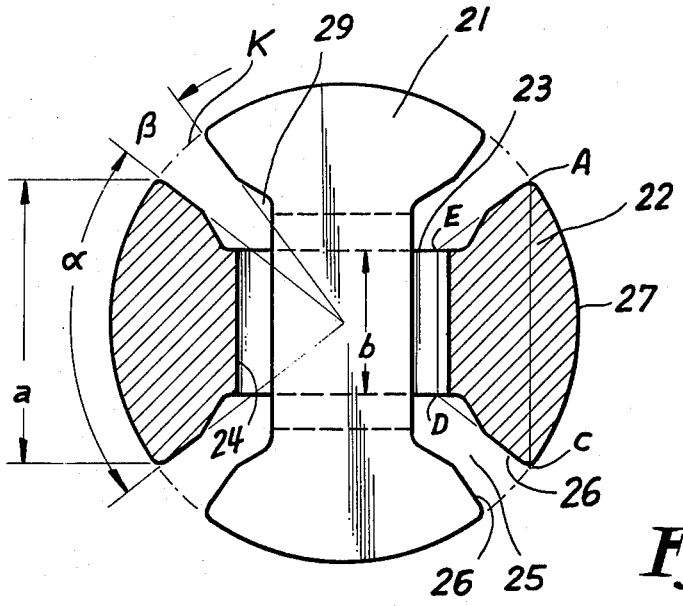
FIG. 5 shows a cross section of a second embodiment of the link chain, evolved from the embodiment of FIG. 3.

The torque transmitting capability of the embodiment of FIG. 5 is further improved by the fact that the radial gaps 25 between the flanks 26 of the longitudinal leg portion 22 are no longer parallel, as in the previous embodiment, but are sector-shaped so that the flanks 26 present large contact surfaces. The sector angle $\alpha$ of the leg portions 22 is again preferably comprised between 70° and 80°, a recess 29 providing a supporting surface around the link eye 23, when the latter is die-cut from the profile stock. The flanks 26 and the recess 29 may also be replaced by an appropriately curved flank profile.

Figure 6:
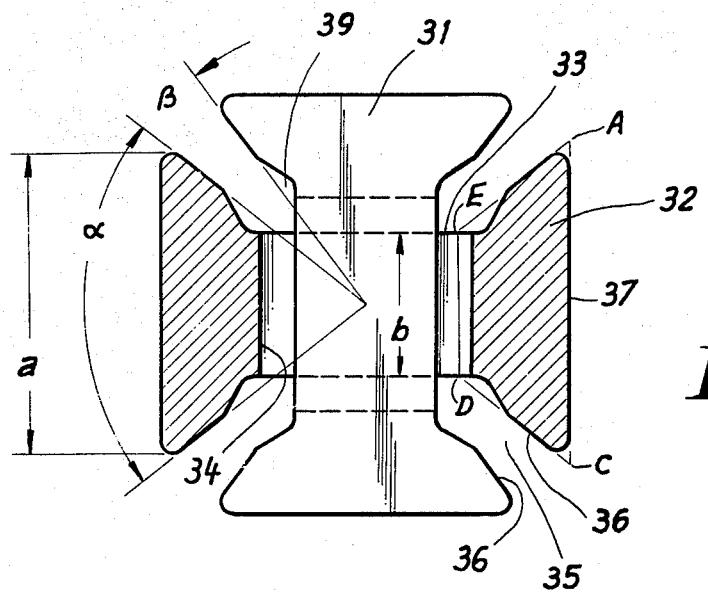
FIG. 6 shows, in a similar representation, a third embodiment of the link chain of the invention.
Figure 7:
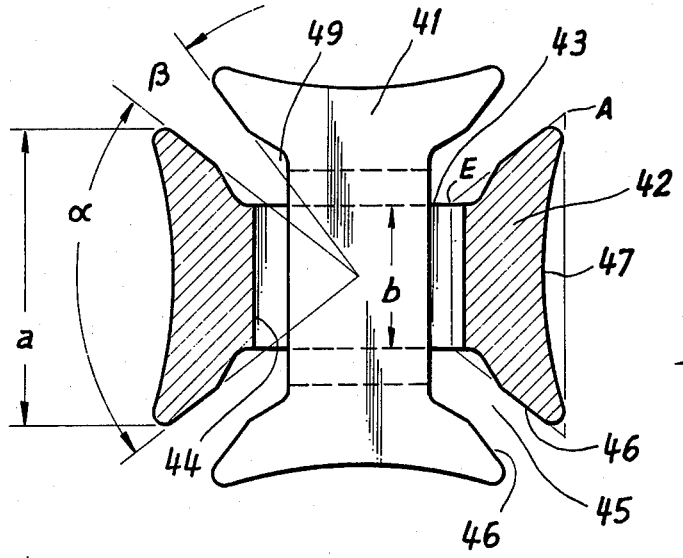
FIG. 7 shows a fourth embodiment of the invention.

FIGS. 6 and 7 show two additional embodiments of the invention. The configuration of FIG. 6 features a generally square cross-sectional outline of the link chain, the profile of the longitudinal leg portion 32 being substantially that of a trapezoid with the corners A, C, D, and E. Here, the facets 17 of FIG. 3 and the arcs 27 of FIG. 5 are replaced by one single outer face 37. The remaining profile details of the link 31, especially the configuration of the radial gaps 35 and the dimensions of the linking portions 33 and eyes 34, correspond essentially to those of FIG. 5. This chain lends itself particularly well for cooperation with an open guide or with guide rollers, when used for other than decorative purposes.

The embodiment of FIG. 7 is a derivative of the embodiment of FIG. 6, differing therefrom only inasmuch as the flat outer face 37 of the link 31 is replaced by a cross-sectionally concave face 47 for the link 41. The profile of the leg portion 42 thus is less than the full area of the trapezoid A-C-D-E, the resulting link chain being lighter in weight, but still giving the same "full" appearance as the previously described embodiment.

The novel method of fabricating the link chain of the invention can best be understood by reference to FIG. 4. The novel links may be mass produced, by first producing a continuous length of wire stock having the exact same I-shaped cross-sectional profile as a single link. This wire stock can be obtained either through extrusion or by rerolling round or rectangular wire into the desired shape. In the case of FIG. 4, the wire stock 50 shown there has a profile from which are obtained the links of FIGS. 1–3.

The operations involved in mass producing the links are extremely simple and can therefore be readily mechanized: One die-cutting operation sheares off a length portion of the wire stock 50, thereby producing the two end faces 51 of a link. A piercing die with a paddle-shaped punch cuts out of the web portion 52 of the stock 50 the rectangular eye 14 as well as a narrow slot 53 which, when the link is severed from the stock at 54, will have longitudinally bi-sected one of the two linking portions 13. A short residual portion 55 of the slot 53 is visible on the opposite end face 51, because the slot 53 reaches a short distance beyond the cut line 54.

The finished link is then simply pried open to the dimension *b* (FIG. 2), the opened link is inserted over the linking portion 13 of the preceding link, and the link is closed by bending its leg portions 12 back into parallel alignment. A slot 19 may remain at the split linking portion 13, or the latter may be closed in a soldering operation, for example. The manufacturing method is particularly suitable for the mass production of inexpensive jewelry and pendant chains, in which case it is not necessary to completely close the split linking portion 13. The fabricating method just described lends itself well for a complete mechanization of the process, using a compound die and an automatic assembly operation.

Instead of having smooth outer surfaces, the link chain 10 of the invention may carry on its links 11 relief-like decorative symbols. An example of such decorative symbols is shown in FIG. 4, at 56. These symbols are preferably embossed on the radially outwardly facing facets or surfaces 17, 27, etc. of the longitudinal leg portions 12, 22, etc. Advantageously, the embossing operation is a rolling operation which is performed in conjunction with the earlier-mentioned wire stock rerolling operation, the embossing rollers being synchronously driven rollers carrying on their surfaces the negative pattern of the desired relief-like decorative symbols.

It should be understood, of course, that the foregoing disclosure describes only preferred embodiments of the invention and a preferred way of performing the method of the invention, and that it is intended to cover all changes and modifications of these examples of the invention which fall within the scope of the appended claims.

I claim the following:

1. A link chain composed of a succession of identical links uniformly shaped and hooked together in an articulated assembly, in which each link reaches through the eyes of two oppositely adjoining links, and wherein a constituent link, when viewed in the direction of its eye aperture, presents the outline of a rectangular frame, defined by a pair of parallel longitudinal leg portions and a pair of transverse linking portions, the leg portions and linking portions giving the eye aperture of the link a generally rectangular outline; and said link, when viewed in the longitudinal direction, presents a generally I-shaped continuous profile, its longitudinal leg portions thereby constituting the two enlarged flange portions of the I, and its transverse linking portions constituting the narrower intermediate web portion of the I, the maximum profile width (a) of the leg portions being, accordingly, substantially larger than the maximum profile width (b) of the linking portions, with the result that the leg portions of the assembled links substantially conceal the eye apertures of these links, and the links occupy the major portion of the space circumscribed by a continuous prism, thereby giving the chain a generally prismatic overall shape and a delimited pivotability and rotatability between its adjoining links.

2. A link chain as defined in claim 1, wherein the two linking portions have a substantially uniform profile width.

3. A link chain as defined in claim 1, wherein the radial outwardly facing surfaces of the leg portions of the links are provided with relief-like decorations.

4. A link chain as defined in claim 1, wherein the profile outline of the link is substantially symmetrical with respect to two perpendicular profile axes whose point of intersection coincides with the longitudinal center axis of the chain; and the profile width of the longitudinal leg portions, when expressed as a sector angle with respect to the center axis of the chain, occupies an angle $\alpha$ of at least 60°.

5. A link chain as defined in claim 4, wherein said sector angle is comprised between 70° and 80°.

6. A link chain as defined in claim 1, wherein the profile of the longitudinal leg portions includes oppositely inclined flanks forming a transition between said maximum profile width (a) and said narrower linking portions.

7. A link chain as defined in claim 6, wherein the inclined flanks of the longitudinal leg portions are so oriented that, together with the inclined flanks of an adjoining regularly aligned link, they form four substantially parallel radial gaps between the links.

8. A link chain as defined in claim 6, wherein the inclined flanks of one longitudinal leg portion of the link are oriented for substantial radial alignment with the inclined flanks of the other leg portion, meaning that the four flanks coincide with two inclined planes through the longitudinal center axis of the chain.

9. A link chain as defined in claim 8, wherein the profile of the longitudinal leg portions includes a recess in an area which includes the junction point between said radially aligned inclined flanks and the linking portions.

10. A link chain as defined in claim 6, wherein the profile of the longitudinal leg portions is derived from a polygon composed of a shallow isosceles triangle and a trapezoid, both having said maximum profile width (a) as their common base, the top side of the trapezoid being oriented towards and substantially equal in length to the profile width of the linking portion, and the inclined sides of the trapezoid being said inclined flanks of the leg portion profile.

11. A link chain as defined in claim 10, wherein the vertex angle of said triangle is approximately 135°, with the result that the overall cross-sectional outline of the chain approximates that of an octagonal prism.

12. A link chain as defined in claim 6, wherein the profile of the longitudinal leg portions is derived from a geometric shape composed of a shallow segment of a circle and a trapezoid both having said maximum profile width (a) as their common base, the top side of the trapezoid being oriented towards and substantially equal in length to the profile width of the linking portion, and the inclined sides of the trapezoid being said inclined flanks of the leg portion profile.

13. In a link chain as defined in claim 12, wherein said segment of a circle of the profile of the longitudinal leg portions coincides with a circle circumscribing the I-shaped link profile, with the result that the overall cross-sectional outline of the chain approximates that of a cylinder.

14. A link chain as defined in claim 6, wherein the profile of the longitudinal leg portions is derived from a trapezoid having said maximum profile width (a) as a radially outwardly facing base, its top side being oriented towards and substantially equal in length to the profile width of the linking portion, and the inclined sides of the trapezoid being said inclined flanks of the leg portion profile, with the result that the overall cross-sectional outline of the chain approximates that of a square prism.

15. A link chain as defined in claim 14, wherein said trapezoid defining the leg portion profile has a concavely contoured outwardly facing base.

16. A method of fabricating a link chain composed of a succession of identical links hooked together in an articulated assembly, in which each link reaches through the eyes of two oppositely adjoining links, the method comprising the steps of:

fabricating a continuous length of wire stock having a generally I-shaped profile, with two flange portions and a narrower intermediate web portion;

cross-cutting said wire stock so as to obtain a link having parallel end faces produced by the cross-cutting operation;

piercing the web portion of said wire stock so as to obtain a generally rectangular eye aperture in said link, in such a configuration that the flange portions of the wire stock profile form two longitudinal leg portions of the link and the remaining web portion forms two transverse linking portions at opposite ends of the link;

longitudinally splitting apart one of said linking portions;

bending the link so as to open up the split linking portion;

inserting the bent-open linking portion over the eye of another link; and bending the inserted open linking portion closed.

17. A link chain fabricating method as defined in claim 16, wherein the steps of piercing the eye and splitting one linking portion are performed in a combined piercing operation using a piercing punch of paddle-shaped cross section whose handle portion cuts a narrow longitudinal slot into one of the two linking portions.

18. A link chain fabricating method as defined in claim 17, wherein said combined piercing operation precedes the cross-cutting operation; and the handle portion of said piercing punch cross section is so shaped that the length of the slot which is produced by it reaches in the direction of, and a short distance beyond, the plane in which the subsequent cross-cutting operation takes place.

19. A link chain fabricating method as defined in claim 16, comprising the additional step of:

embossing relief-like decorations on the radially outwardly facing surfaces of the flange portions of the profile.

20. A link chain fabricating method as defined in claim 19, wherein the step of embossing involves the use of synchronously driven embossing rollers; and the steps of fabricating and embossing are performed in simultaneous rolling operations.

* * * * *